US008146471B2

(12) United States Patent
Hansen et al.

(10) Patent No.: US 8,146,471 B2
(45) Date of Patent: Apr. 3, 2012

(54) SHEET MATERIAL DISPENSER

(75) Inventors: Lawrence R. Hansen, Green Bay, WI (US); Daniel C. Kananen, Green Bay, WI (US); Sheldon P. Carr, West Bend, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 408 days.

(21) Appl. No.: 12/043,420

(22) Filed: Mar. 6, 2008

(65) Prior Publication Data

US 2008/0217350 A1 Sep. 11, 2008

Related U.S. Application Data

(60) Provisional application No. 60/905,128, filed on Mar. 6, 2007.

(51) Int. Cl.
*B26D 1/62* (2006.01)

(52) U.S. Cl. ..... 83/337; 83/649; 83/949

(58) Field of Classification Search ..... 83/337, 83/649, 949, 650, 334, 335; 225/72, 91
See application file for complete search history.

(56) References Cited

U.S. PATENT DOCUMENTS

| | | | |
|---|---|---|---|
| 1,794,205 | A | 2/1931 | Ridderstrom |
| 2,278,029 | A | 3/1942 | Walsh et al. |
| 2,957,636 | A | 10/1960 | Lesavoy |
| 3,007,650 | A | 11/1961 | Burton |
| 3,017,131 | A | 1/1962 | Wooster |
| 3,127,121 | A | 3/1964 | Babin |
| RE28,911 | E | 7/1976 | Jespersen et al. |
| 4,122,738 | A | 10/1978 | Granger |
| 4,188,844 | A | 2/1980 | DeLuca |
| 4,213,363 | A | 7/1980 | Granger |
| 4,307,639 | A | 12/1981 | DeLuca |
| 4,404,880 | A | 9/1983 | DeLuca |
| 4,432,261 | A | 2/1984 | DeLuca |
| 4,441,392 | A | 4/1984 | DeLuca |

(Continued)

FOREIGN PATENT DOCUMENTS

AT 406545 B 6/2000

(Continued)

OTHER PUBLICATIONS

PCT International Application No. PCT/US2008/002961. International Preliminary Report on Patentability. Date: Aug. 4, 2009. 11 pages.

(Continued)

*Primary Examiner* — Stephen Choi
(74) *Attorney, Agent, or Firm* — Jansson Shupe & Munger Ltd.

(57) ABSTRACT

Apparatus for dispensing sheet material from a sheet material dispenser are described. Dispenser embodiments include drive and tension rollers supported within a housing forming a nip therebetween. Pulling of sheet material through the nip and against the drive roller rotates the drive roller. Dispenser embodiments may include a cutting mechanism powered by drive roller rotation with an improved carrier-supported blade permitting highly-efficient dispenser operation. Dispenser embodiments may include a sheet material tail length adjuster which permits the attendant to shorten or lengthen the tail length extending away from the dispenser. Dispenser embodiments may further include a sheet material conservation feature which imposes a delay between dispense cycles encouraging use of a single sheet of material and discouraging sheet material waste.

16 Claims, 15 Drawing Sheets

U.S. PATENT DOCUMENTS

| | | | | |
|---|---|---|---|---|
| 4,621,755 | A | 11/1986 | Granger | |
| 4,635,837 | A | 1/1987 | Granger | |
| 4,712,461 | A | 12/1987 | Rasmussen | |
| 4,738,176 | A | 4/1988 | Cassia | |
| 4,846,035 | A | 7/1989 | Granger | |
| 5,048,386 | A | 9/1991 | DeLuca et al. | |
| 5,294,192 | A | 3/1994 | Omdoll et al. | |
| 5,314,131 | A | 5/1994 | McCanless et al. | |
| 5,441,189 | A | 8/1995 | Formon et al. | |
| 5,628,474 | A | 5/1997 | Krueger et al. | |
| 5,772,291 | A | 6/1998 | Byrd et al. | |
| 5,924,617 | A | 7/1999 | LaCount et al. | |
| 5,937,718 | A | 8/1999 | Granger | |
| 5,979,822 | A | 11/1999 | Morand et al. | |
| 6,032,898 | A | 3/2000 | LaCount et al. | |
| 6,105,898 | A | 8/2000 | Byrd et al. | |
| 6,112,631 | A | 9/2000 | Van-Alstine | |
| 6,224,010 | B1 | 5/2001 | Morand | |
| 6,237,871 | B1 | 5/2001 | Morand et al. | |
| 6,250,530 | B1 | 6/2001 | LaCount et al. | |
| 6,257,443 | B1 | 7/2001 | LaCount | |
| 6,293,486 | B1 | 9/2001 | Byrd et al. | |
| 6,314,850 | B1 | 11/2001 | Morand | |
| 6,318,213 | B1 * | 11/2001 | Hendrix et al. | 30/169 |
| 6,363,825 | B1 * | 4/2002 | Hagleitner | 83/337 |
| 6,364,245 | B1 | 4/2002 | Paal et al. | |
| 6,390,410 | B1 | 5/2002 | LaCount et al. | |
| 6,412,679 | B2 | 7/2002 | Formon et al. | |
| 6,446,901 | B1 | 9/2002 | Haen et al. | |
| 6,460,798 | B1 | 10/2002 | Haen et al. | |
| 6,553,879 | B2 | 4/2003 | Morand | |
| 6,684,751 | B2 | 2/2004 | Kapiloff et al. | |
| 6,695,246 | B1 | 2/2004 | Elliott et al. | |
| 6,766,977 | B2 | 7/2004 | Denen et al. | |
| 6,846,035 | B2 | 1/2005 | Wong et al. | |
| 6,854,684 | B2 | 2/2005 | Byrd et al. | |
| 6,903,654 | B2 | 6/2005 | Hansen et al. | |
| 6,977,588 | B2 | 12/2005 | Schotz et al. | |
| 6,988,689 | B2 | 1/2006 | Thomas et al. | |
| 7,040,566 | B1 | 5/2006 | Rodrian et al. | |
| 7,084,592 | B2 | 8/2006 | Rodrian | |
| 7,296,765 | B2 | 11/2007 | Rodrian | |
| 7,325,767 | B2 | 2/2008 | Elliott et al. | |
| 7,325,768 | B2 | 2/2008 | Byrd et al. | |
| 7,354,015 | B2 | 4/2008 | Byrd et al. | |
| 7,357,348 | B2 | 4/2008 | Kananen | |
| 2001/0017309 | A1 | 8/2001 | Formon et al. | |
| 2002/0109036 | A1 | 8/2002 | Denen et al. | |
| 2002/0152871 | A1 | 10/2002 | Granger | |
| 2004/0188486 | A1 * | 9/2004 | Granger | 83/649 |
| 2005/0051008 | A1 * | 3/2005 | Granger | 83/335 |
| 2005/0077420 | A1 | 4/2005 | Kaufmann | |
| 2006/0266784 | A1 | 11/2006 | Kananen | |
| 2007/0080255 | A1 | 4/2007 | Witt et al. | |
| 2007/0158359 | A1 | 7/2007 | Rodrian | |

FOREIGN PATENT DOCUMENTS

| | | |
|---|---|---|
| CA | 2439918 | 9/2002 |
| DE | 26 39 810 | 9/1976 |
| GB | 2003831 A | 8/1978 |
| WO | WO 00/18673 | 4/2000 |
| WO | WO 02/072320 | 9/2002 |
| WO | WO 2006/011881 | 2/2006 |

OTHER PUBLICATIONS

Informal Comments to Written Opinion for PCT International Application No. PCT/US2008/002961. Date: Aug. 19, 2008. 4 pages.
Hagleitner Hygiene International GmbH brochure. Date: 2006.
Alwin Manufacturing Company, Inc. Model 205 paper towel dispenser brochure. Date: Copyright 2003.
PCT International Application No. PCT/US2008/002961. International Search Report and Written Opinion. Date: Jun. 19, 2008 (11 pages).
Perrin Manufacturing Company Towel Dispenser chassis (1 photograph). Date: Nov. 16, 2004.

* cited by examiner

SHEET MATERIAL DISPENSER

RELATED APPLICATION

This application claims the benefit of U.S. Provisional Patent Application Ser. No. 60/905,128 filed Mar. 6, 2007, the entire contents of which are incorporated herein by reference.

FIELD

The field relates to dispenser apparatus and, more particularly, to sheet material dispensers.

BACKGROUND

Dispensers for flexible sheet material in the form of a web, such as paper towel, cloth towel, tissue and the like, are well known in the art. Certain types of sheet material dispensers are powered through some or all of a dispense cycle by a drive mechanism including one or more springs. In such dispensers, a dispense cycle is initiated when a user grasps and pulls the sheet material "tail" which is the sheet material end which extends out from the dispenser. Pulling of the tail causes movement of the sheet material to rotate a drive roller and energizes a spring or springs attached to the drive roller. The spring or springs then power rotation of the drive roller through completion of the dispense cycle. Rotation of the drive roller powers operation of a cutting mechanism carried on the drive roller to fully or partially sever the web. A relatively high spring force is required in order to power the drive roller and cutting mechanism to fully or partially sever the sheet material web to provide a single sheet for the user. Typically, a pull force of about two pounds or more is required to overcome the force applied to the drive roller by the spring or springs.

While these dispenser types are very effective for their intended purpose, there is opportunity for improvement. For example, the relatively high pull force required to rotate the drive roller to initiate a dispense cycle can cause a problem known as "tabbing." Tabbing refers to a condition in which a small portion of the sheet material tail tears off in the user's hand. The small portion which is torn off of the tail is referred to as a "tab." The tab includes insufficient material to meet the user's needs. And, the remaining tail extending from the dispenser may be inadequate for a user to grip to initiate a new dispense cycle, thereby potentially disabling the dispenser. Tabbing can be a particular problem if water transferred from the user's hands to the tail causes the sheet material to moisten and to tear when pulled.

Paper and sheet material conservation is increasingly important, both for cost and environmental reasons. Dispensers of the type described above can be repeatedly and immediately cycled to dispense multiple sheets of material to the user. The capability to repeatedly and immediately cycle the dispenser encourages excessive use of sheet material, thereby increasing cost and waste. Small amounts of sheet material saved during each use represent large cumulative savings over the operational life of the dispenser.

It may be desirable to lengthen or shorten the sheet material tail. For example, it may be desirable to adjust the length of the tail to make the tail easier to grasp depending on the height or position at which the dispenser is located on a wall or other support surface. It may be desirable to adjust the length of the tail based on the type of user anticipated to use the dispenser. For example, a longer tail may be desirable if the dispenser is to be installed in a rest room used primarily by small children.

Dispensers of the type described above lack structure permitting the attendant to lengthen or shorten the tail extending from the dispenser housing.

It would be an advance in the art to provide improved sheet material dispensers for paper towel, tissue and other materials which would operate easily and require a minimal pull force on the sheet material tail to initiate a dispense cycle, which would facilitate and encourage sheet material conservation and which would be capable of tail length adjustment.

SUMMARY

Sheet material dispensers are described herein. The dispensers are useful to provide the user with a single sheet of paper towel, tissue, or other sheet-type material in a dispense cycle. As used herein, a dispense cycle refers to one operational cycle of the dispenser which results in providing the user with the single sheet of material.

In preferred embodiments, the dispensers include a housing and a sheet material roll holder which is preferably within the housing. The preferred dispensers further include drive and tension rollers. A nip is formed between the drive and tension rollers. Preferred drive rollers have a rotational axis, ends and a generally cylindrical body positioned so that the sheet material wraps partially around the body and pulling of the sheet material through the nip and against the body rotates the drive roller.

In embodiments, the dispenser includes an improved cutting mechanism which is capable of operation with a low pull force less than half that of conventional dispensers and without the necessity for spring drive mechanisms to power drive roller rotation. The low pull force of the improved cutting mechanism enables use of the dispenser with a range of lightweight papers, tissues and other sheet materials and reduces or eliminates unwanted tabbing.

The preferred cutting mechanism includes a cutting blade and a blade carrier. The preferred blade has a length, a base, a knife with a serrated edge, and a transition between the base and knife. The preferred transition includes a stiffening compound bend and at least one planar section along the length. The preferred blade carrier supports the blade base and at least a portion of the at least one planar section. The carrier is pivotably mounted to the drive roller between cutting and non-cutting positions along an axis close to, and preferably below, the drive roller circumference. The improved blade design and rigid support provided by the carrier are believed to contribute to the improvement in operational efficiency.

In embodiments, the dispenser includes sheet material conservation apparatus. Preferred embodiments include a stop member which co-rotates with the drive roller, a controlled member movable between a first position in which the controlled member is contacted by a stop surface on the stop member to pause drive roller rotation and a second position in which the controlled member releases the stop surface to permit further drive roller rotation to a drive roller resting position. A control circuit responsive to drive roller rotation triggers movement of the controlled member to the second position after pausing the drive roller for a delay time. Preferably, the user receives a single sheet of material before or during the pause. In certain embodiments, a stationary tear bar could be used to tear off a single sheet of material during the pause. The delay between dispense cycles encourages use of a single sheet of material and discourages excessive cycling of the dispenser.

In other embodiments, the dispenser includes tail length adjustment apparatus. In such embodiments, the dispenser includes a cutting mechanism including a blade carried on the drive roller which cuts the sheet material at a first angular position of the drive roller responsive to drive roller rotation. The sheet material is cut such that a tail is extended out of the dispenser by subsequent drive roller rotation to a second angular position corresponding to the resting position of the drive roller between dispense cycles. The tail-length adjuster is associated with the drive roller and is useful to set the second angular position at one of a plurality of angular positions. Preferably, setting of the second position rotates the drive roller to the second angular position. Setting of the second angular position increases or decreases the angular distance between the first and second angular positions, thereby correspondingly increasing or decreasing the tail length. This feature is particularly useful to set the tail length at a position most accessible by the user.

BRIEF DESCRIPTION OF THE DRAWINGS

The foregoing and other objects, features and advantages of the invention will be apparent from the following description of preferred embodiments, as illustrated in the accompanying drawings in which like reference characters refer to the same parts throughout the different views. The drawings are not necessarily to scale, emphasis instead being placed upon illustrating the principles of the invention. In the drawings.

DETAILED DESCRIPTION

Figure 1:
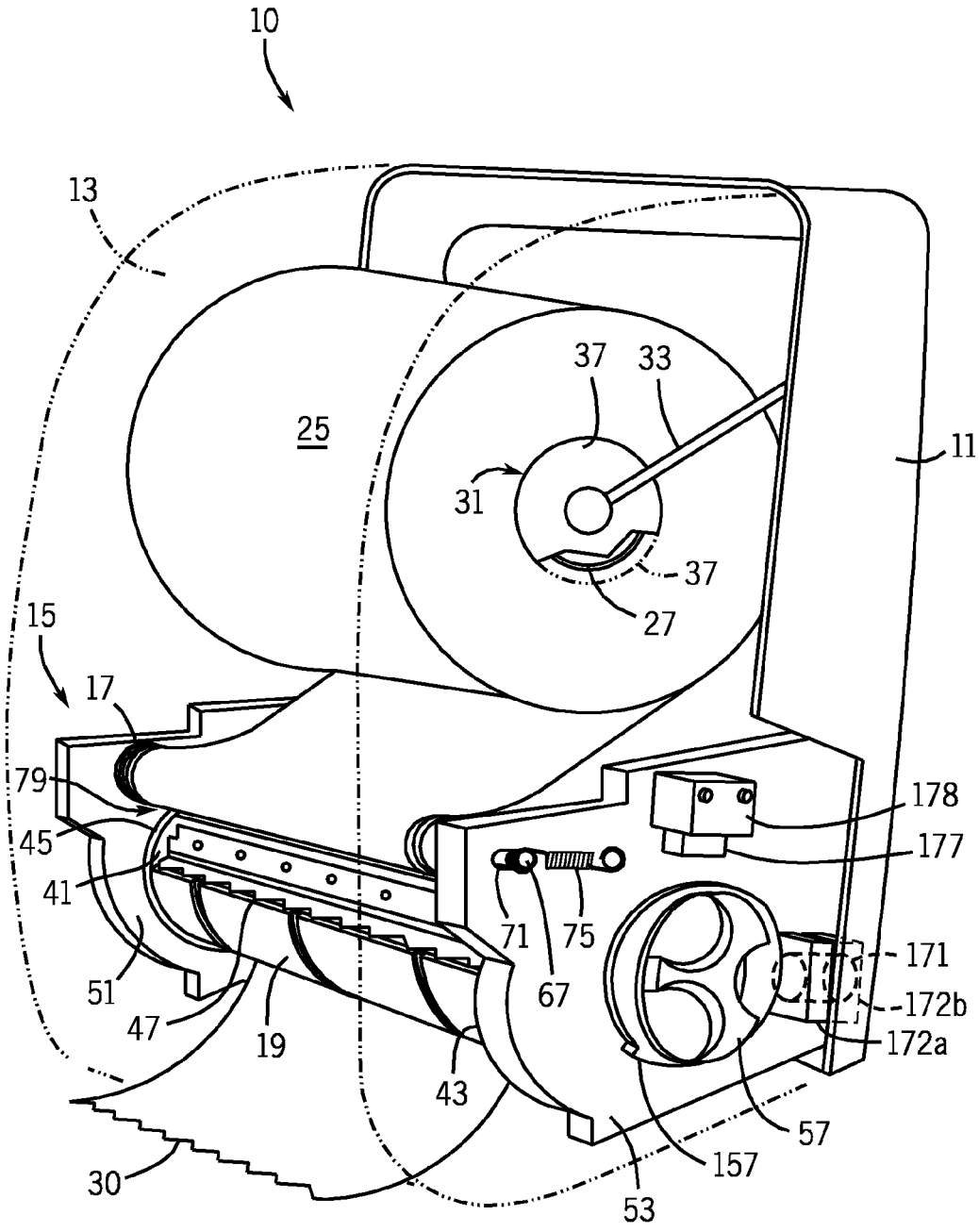
FIG. 1 is a perspective view of an exemplary dispenser including sheet material in the form of a roll of paper towel, the housing cover and certain housing portions being omitted to facilitate understanding.
Figure 2:
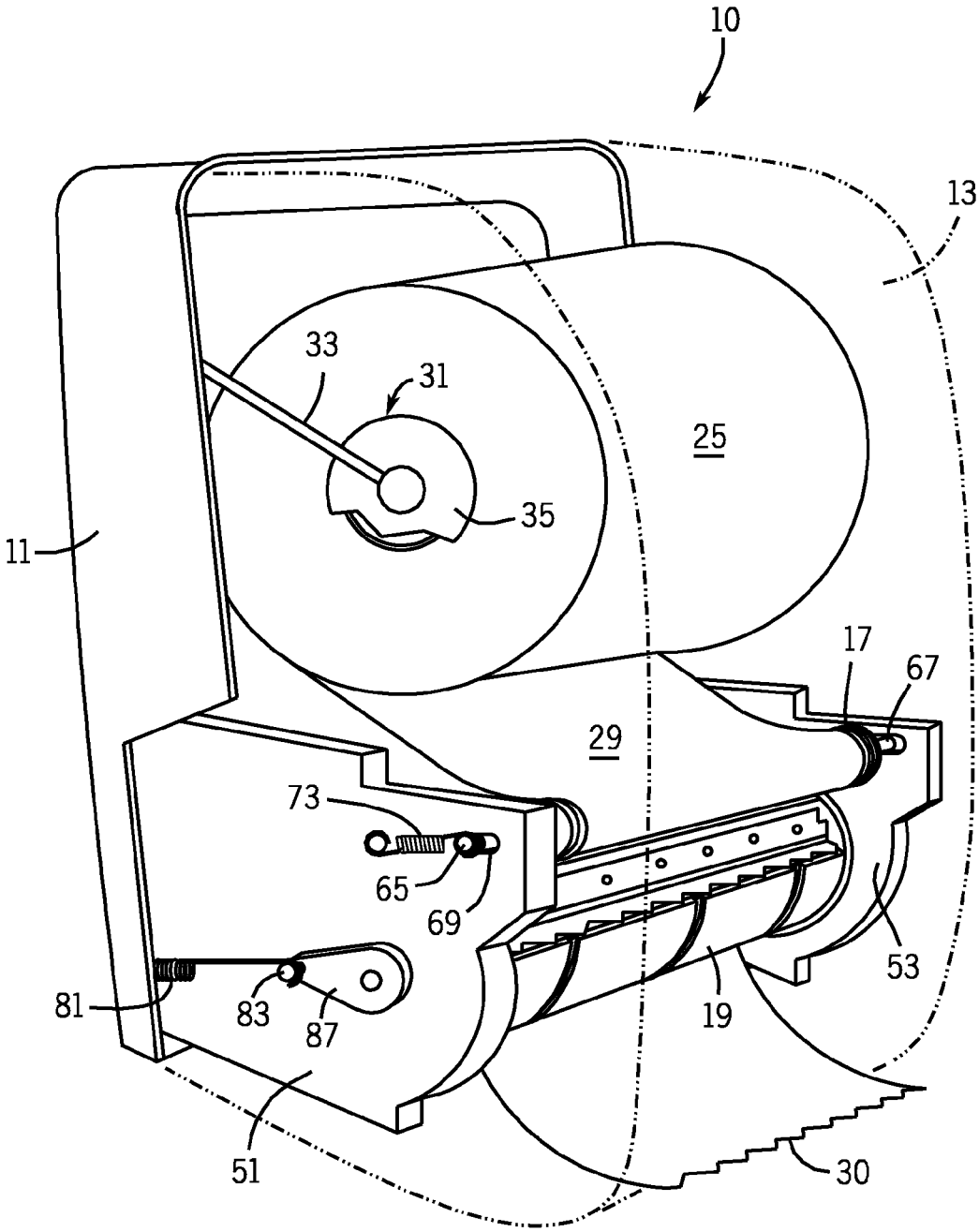
FIG. 2 is a further perspective view of the dispenser of FIG. 1.
Figure 9:
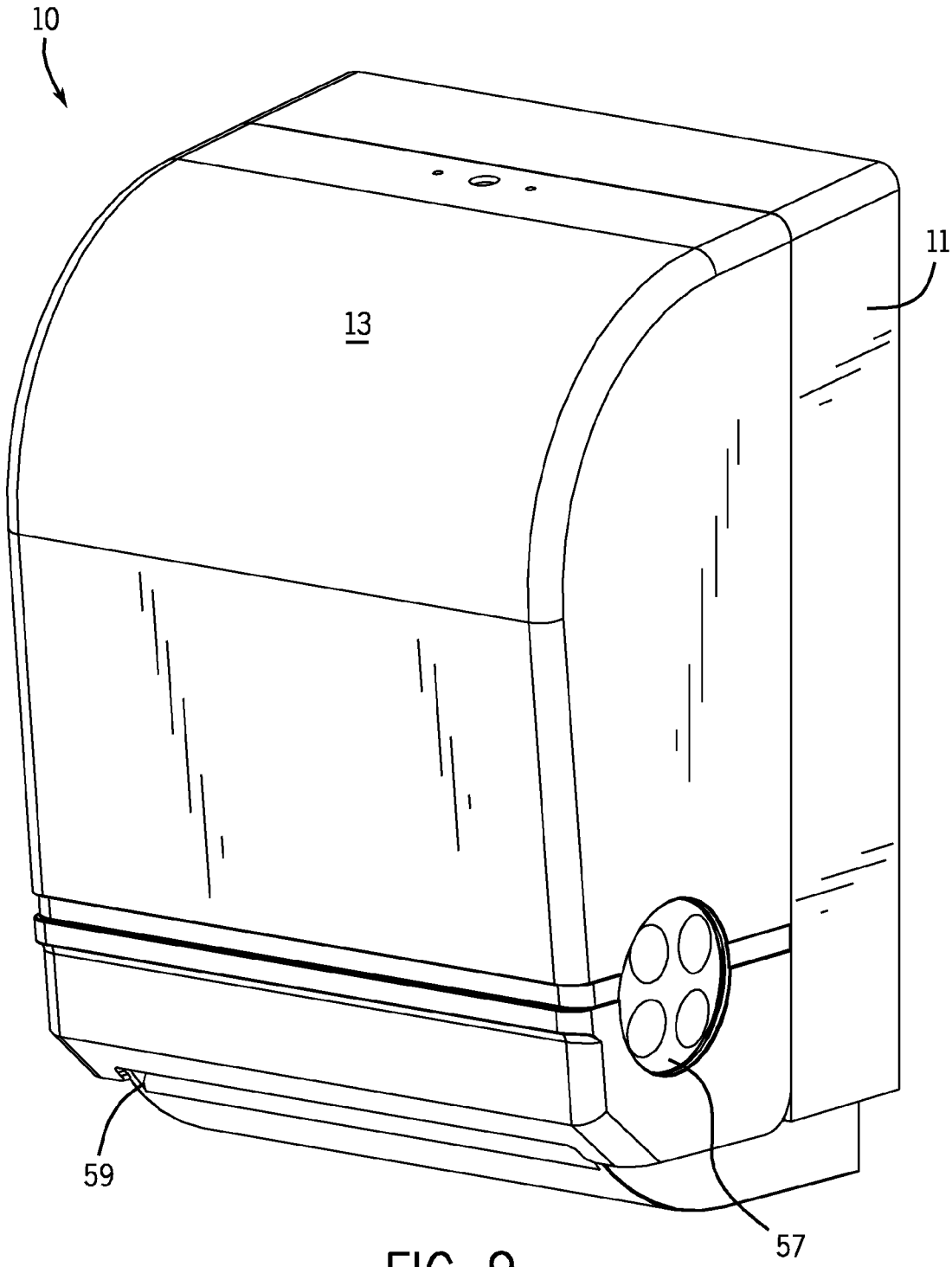
FIG. 9 is a schematic conceptual drawing of the dispenser of FIG. 1 including a housing and housing cover.

The mechanical components comprising preferred embodiments of an exemplary dispenser 10 will first be described. Referring first to FIGS. 1-4 and 9, dispenser 10 preferably includes housing 11 and removable front cover 13 (FIG. 9). As shown in FIGS. 1 and 2, dispenser 10 may be mounted on a vertical wall surface permitting a user to easily access dispenser 10. Housing and cover 11, 13 may be made of any suitable material or materials such as formed sheet metal, plastic and the like.

Frame 15 portion of housing 11 supports tension roller 17, drive roller 19 (referred to by some in the industry as a "drum"), sheet material conservation apparatus 21 components, tail length adjustment apparatus 23 components, and other components as described herein. Frame 15 may be of any suitable type and may, for example, comprise an integral part of housing 11 or be a separate component mounted within housing 11.

Preferably, dispenser 10 is adapted to dispense sheet material from a sheet material roll 25. As is well known, sheet material in roll 25 form comprises a hollow cylindrically-shaped tubular core 27 and sheet material in the form of a web 29 of sheet material wrapped around the core 27. The core 27 is typically a hollow tube made of cardboard, plastic or the like.

A sheet material roll holder 31 supports sheet material roll 25 within housing 11 and behind cover 13. Roll holder 31 may comprise a yolk 33 made, for example, of wire and holders 35, 37 inserted into the hollow core 27. The portions of yolk 33 supporting holders 35, 37 may be spread apart so that holders 35, 37 may be inserted into roll 25. Roll 25 is free to rotate when mounted on holders 35, 37.

As will be appreciated, any type of roll holder structure may be utilized to support roll 25. For example, holder 31 could be a rod inserted through roll core 27. Such a rod may be supported at its ends by housing 11.

There is no particular requirement with respect to the number of sheet material sources which may be dispensed from dispenser 10. It is envisioned that dispenser 10 may be used to dispense from a further roll of sheet material (not shown) by means of a suitable sheet material transfer mechanism as described in commonly-owned U.S. Pat. No. 6,460,798.

Preferred drive roller 19 may be a drum-shaped member which has a generally-cylindrical body 39. In the embodiment, drive roller 19 has ends 41, 43, circumference 45 and an optional blade-extending opening 47 provided in body 39 at circumference 45. Drive roller 19 rotates about rotational axis 49. Axially-aligned stub shafts (not shown) may extend outward from each end 41, 43 of drive roller 19 and are preferably journaled in a respective frame wall 51, 53 by means of bearings (not shown) seated in wall 51, 53. Bearings may be radial bearings or bearings of a low-friction material, such as nylon. Walls 51, 53 are transverse to rotational axis 49 proximate ends 41, 43.

Figure 19:
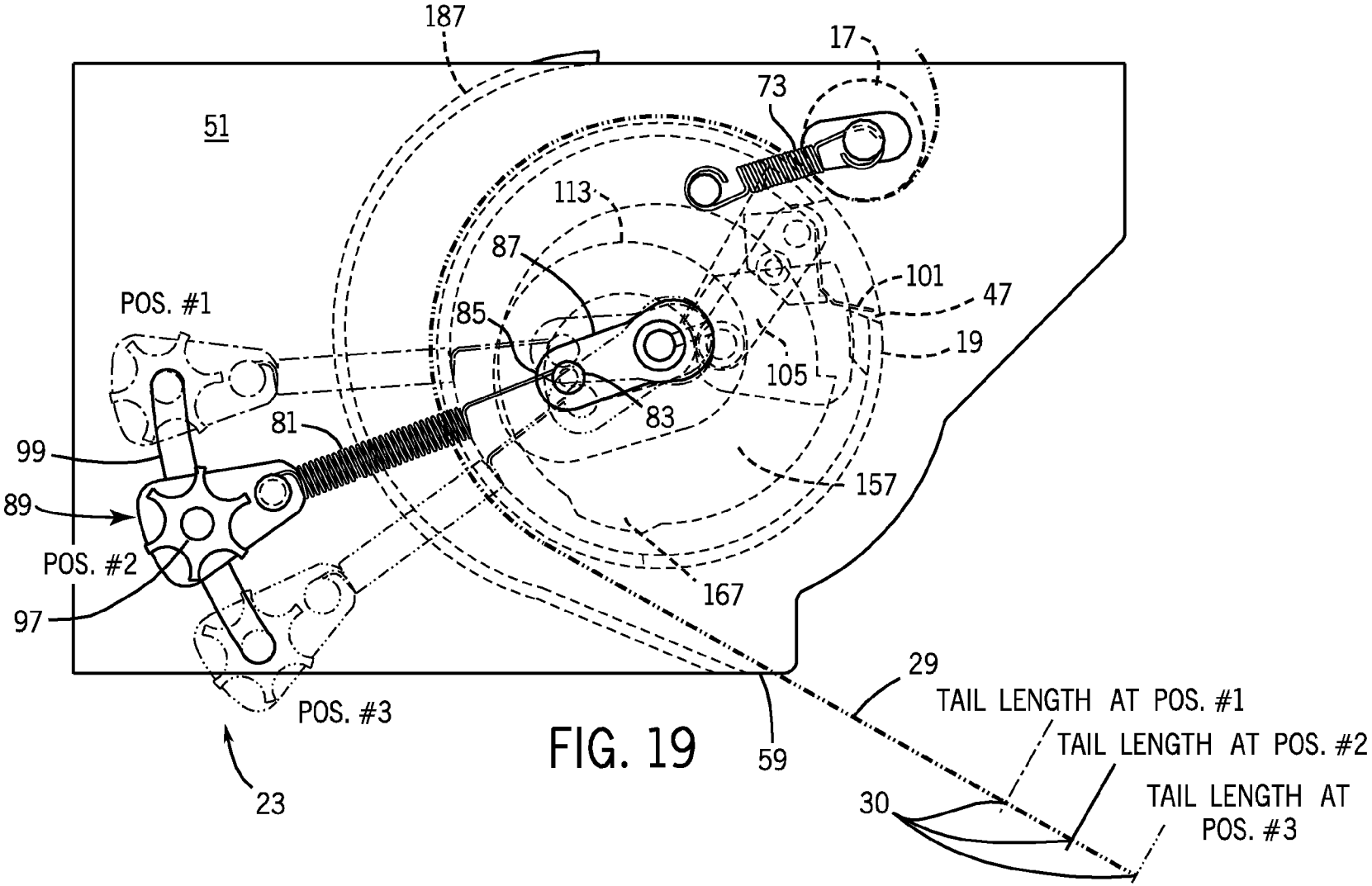
FIG. 19 is a schematic illustration of a second embodiment of an exemplary tail length adjustment apparatus.

As can be seen in FIGS. 1, 2 and 19, web 29 of sheet material is wrapped partially around body 39 during use. Drive roller 19 is rotated about rotational axis 49 by user pulling of sheet material web 29 tail 30 extending away from dispenser 10. The term "drive roller" as used herein refers to the main web-contacting roller 19. The term "drive roller"

was chosen because, in certain examples, rotation of the drive roller 19 at least partially powers, or drives, cutting mechanism 61 as described herein. The term "drive roller" also refers to the main web-contacting roller of embodiments which do not include a cutting mechanism 61 and which may include, for example, a stationary tear bar provided to permit user separation of a sheet of material from the web 29.

Drive roller 19 may be constructed in any suitable manner and may be made of joined-together first and second sections joined by use of adhesives or fasteners, such as machine screws. Drive roller 19 may be made of plastic or any other suitable material.

Figure 3:
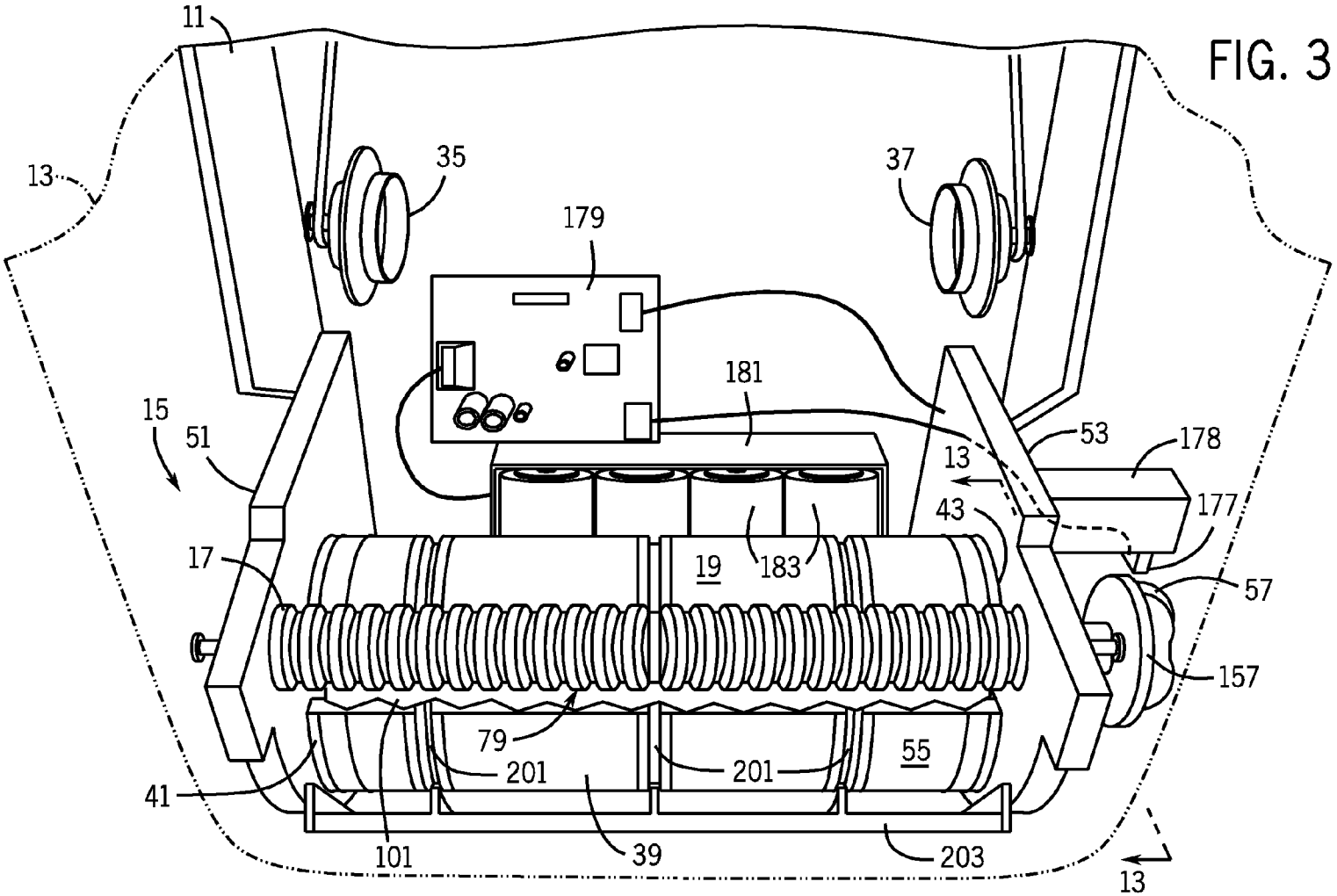
FIG. 3 is an enlarged partial view of the dispenser of FIG. 1, not including the paper towel roll.
Figure 4:
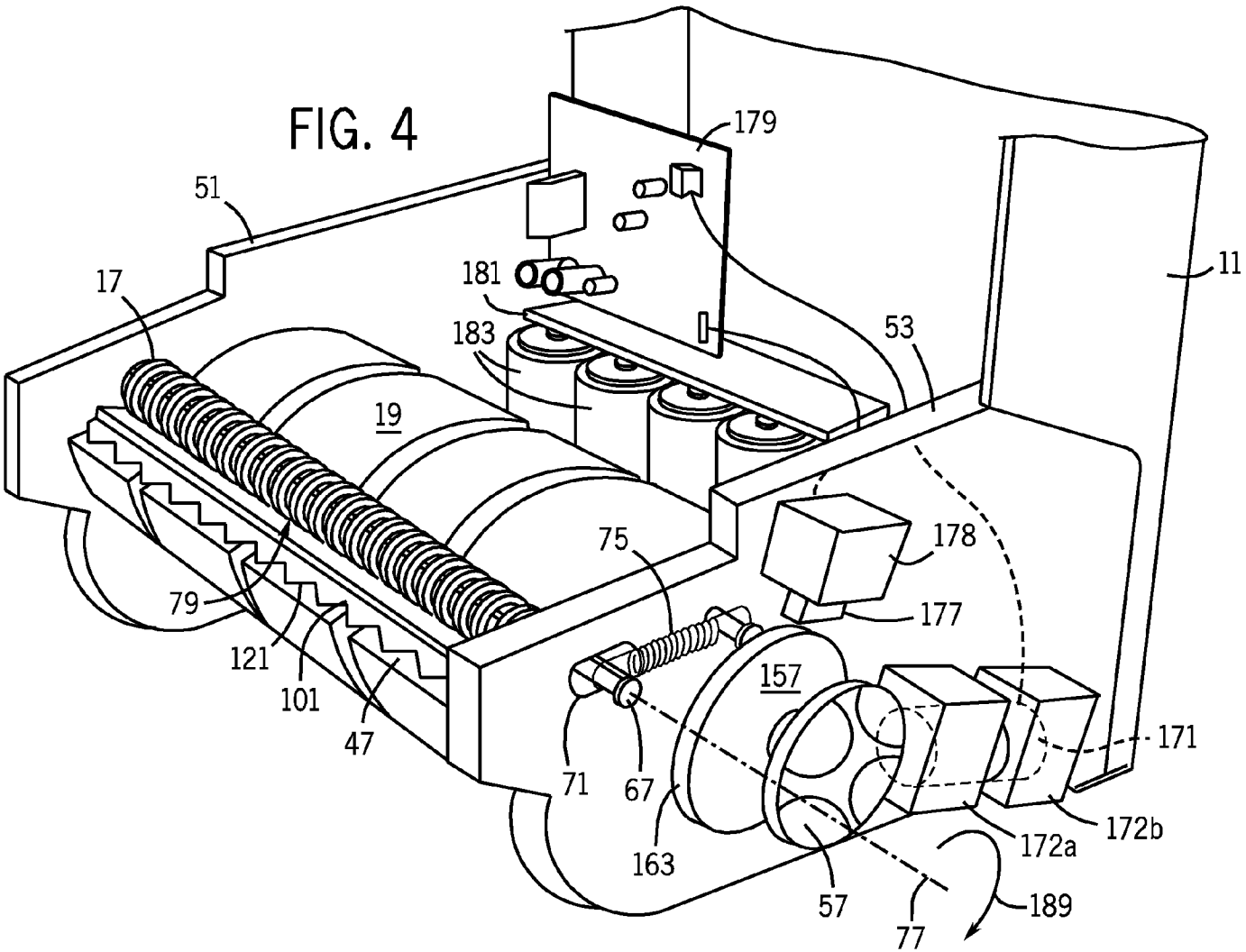
FIG. 4 is a further enlarged partial view of the dispenser of FIG. 1 showing certain components of a preferred sheet material conservation apparatus.

As shown in FIG. 3, frictional surfaces 55 may be provided along circumference 45 of body 39 for engaging and gripping web 29. Friction surfaces 55 are provided to ensure that the drive roller 19 has sufficient frictional contact with web 29 so that drive roller 19 will rotate as web 29 wrapped partially around drive roller 19 is pulled from dispenser 10 by a user. Friction surfaces 55 may be in the form of sheet-like strips adhered to drive roller 19 with a suitable adhesive (not shown). However, such friction surfaces 55 could be provided in other manners, such as by forming such friction surfaces directly in roller 19. Further, the friction surfaces 55 need not be limited to the plural strip-like material shown and could comprise any appropriate configuration, such as a single sheet of material (not shown). Friction surfaces 55 may consist of any suitable high-friction material, such as grit or rubberized material. An over-molded thermoplastic elastomer may also be applied to drive roller 19. Such an elastomer is applied directly to the drive roller and sets to form a gripping surface similar to friction surfaces 55. A stripper bar 203 (FIG. 3) may be provided with teeth that ride in grooves 201 to separate web 29 from drive roller 19.

Referring to FIGS. 1, 3-6 and 9, a hand wheel 57 connected to drive roller 19 may optionally be provided. Hand wheel 57 is provided to permit manual rotation of drive roller 19, such as to feed web 29 out from dispenser 10 through discharge opening 59 at the time web 29 is loaded into dispenser 10. This presents a tail 30 to the user for pulling to initiate a dispense cycle. In embodiments, hand wheel 57 may be fully enclosed within housing 11 permitting access only by the attendant.

Blade-extending opening 47 preferably is a longitudinal opening in circumference 45 of body 39 between ends 41, 43 through which a cutting mechanism 61 cutting blade 101 extends to sever the web 29 as hereinafter described.

Tension roller 17 urges web 29 against the outer surface of drive roller 19. Tension roller 17 preferably is a generally cylindrically-shaped member having first and second axial stub ends 65, 67 carried in slots 69, 71 of frame walls 51, 53. As shown in FIGS. 1-2, and 4-6, tension springs 73, 75 urge tension roller 17 against drive roller 19. Tension roller 17 is generally coextensive with drive roller 19 and is mounted along an axis 77 parallel to drive roller rotational axis 49. Tension roller 17 may be provided with tactile material (not shown) along its surfaces which contact web 29 to ensure positive contact with the web 29.

A nip 79 is formed at the junction of the tension and drive rollers 17, 19. Pulling of sheet material tail 30 by a user causes web 29 material to be drawn from roll 25 on roll holder 31 through nip 79 and against the outer surface of drive roller 19. Frictional contact between web 29 and circumference 45 of drive roller 19 during user web pulling rotates drive roller 19 to power, or drive, cutting mechanism 61. A single sheet of web 29 material is provided to the user through discharge opening 59.

Referring to FIGS. 2, 7-8, and 19, spring 81 may be provided to bias drive roller 19 to a resting position between dispense cycles. Spring 81 is a light-duty spring which is provided to return drive roller 19 to its resting position at the end of a dispense cycle. Spring 81 is not required for powering of drive roller 19 rotation during a dispense cycle. Preferably, spring 81 is a component of tail length adjustment apparatus 23 optionally provided to increase or decrease the length of tail 30 extending out of dispenser 10.

In the embodiments, spring 81 is attached at one end to post 83 along distal end 85 of eccentric arm 87 connected to the shaft (not shown) which supports drive roller end 41. Arm 87 co-rotates with drive roller 19. If tail length adjustment apparatus 23 is not provided, the spring second end is attached to a fixed position along wall 51 (not shown).

In embodiments including tail length adjustment apparatus 23, spring 81 is attached at its second end to a positioner 89. In the embodiment of FIGS. 1-8, positioner 89 comprises a base 91 threaded on a set screw 93 in wall 51 proximate drive roller end 41. Set screw 93 may be turned by rotation of knob 94. In the example, base 91 is positionable up-and-down to one of plural positions along slot 95 provided in wall 51 by rotation of set screw 93. Stated another way, base 91 may be moved to any position along slot 95 by set screw 93.

In the embodiment of FIG. 19, positioner 89 comprises a locking knob 97 secured to wall 51. Knob 97 is preferably movable to one of a plurality of positions along a slot 99 in wall 51. Preferably, slot 99 defines an arc spaced radially outward from drive roller rotational axis 49. Knob 97 may be moved to any position along slot 99. Three of the many positions for knob 97 are represented in FIG. 19.

Movement of base 91 or knob 97 to one of the plural positions along wall 51 rotates drive roller 19 through spring 81 and arm 87 to one of plural angular positions corresponding to a drive roller resting position between dispense cycles. In addition to biasing drive roller 19 to the resting position, spring 81 acts like a brake limiting clockwise or counterclockwise rotational movement of drive roller 19 at the resting position so that the drive roller 19 is in the correct position to initiate a new dispense cycle for a user. Operation of the tail length adjustment apparatus 23 is described in more detail below.

Referring to FIGS. 2-3, 7 and 10-15, a preferred cutting mechanism 61 for severing web 29 is illustrated. Cutting mechanism 61 preferably cuts fully through web 29 positioned against the outer surface of drive roller 19 as drive roller 19 rotates under the force applied by user web pulling. Cutting mechanism 61 is highly efficient and can sever web 29 with pull forces of between about 0.7 pounds to about 1.2 pounds of pull force depending on the basis weight of the sheet material web 29 dispensed from dispenser 10. (As measured using a calibrated pull-force testing device). The capability of severing a web of sheet material 29 using a pull force of one pound or less is highly desirable. Such a cutting mechanism 61 avoids the need for separate high-force springs powering rotation of drive roller 19 and the related need to provide over two pounds of pull force to overcome the springs to rotate drive roller 19 to initiate a dispense cycle. Reduction of required pull force minimizes or eliminates "tabbing," and permits use of dispenser 10 with a broad range of paper towel and other sheet-form web 29 material.

For example, cutting mechanism 61 will operate to neatly and easily sever web material 29 in the form of one and two-ply paper sheet material having a basis weight of between about 18 to about 26 pounds. Thin, lightweight paper towel is at the low end of this basis weight range while absorbent two-ply towel is at the upper end of the basis weight range. Without wishing to be bound by any particular theory, it is believed that improvements in the blade 101 and blade carrier 103 contribute to severing of web 29 with pull forces of one pound or less.

Exemplary cutting mechanism 61 comprises blade 101, blade carrier 103, arms 105, 107, followers 147, 149, cams 113, 115 and the related components. Blade 101 has a length 117, a base 119, a knife 121 with a serrated edge 123, and a transition 125 between base 119 and knife 121. Transition 125 includes structure which stiffens blade 101. Such structure preferably comprises a compound bend 127 and a planar section 129 along length 117. While one planar section 129 and a compound bend 127 with two bends are shown, additional sections 129 and bends 127 may be utilized.

It has been found that 31 gauge 300 series half-hard stainless steel is useful in manufacture of blade 101. Use of 31 gauge stainless steel, results in a knife 121 having a thickness between serrated edge 123 and transition 125 of about 0.0105 inches.

Blade carrier 103 has ends 131, 133 and a first surface 135 abutting and supporting base 119. In the example, plural screws 137 affix base 119 to carrier surface 135 providing complete support of base 119 and knife 121 along the entirety of length 117. Blade carrier 103 further includes a second surface 139 which abuts and supports at least a portion of planar section 129. Transition 125 and bends 127 stiffen blade 101 while carrier 103 supports blade. This structure limits torsional flexing of blade 101, thereby contributing to more efficient severing of web 29 and requiring less energy to sever web 29.

Figure 10:
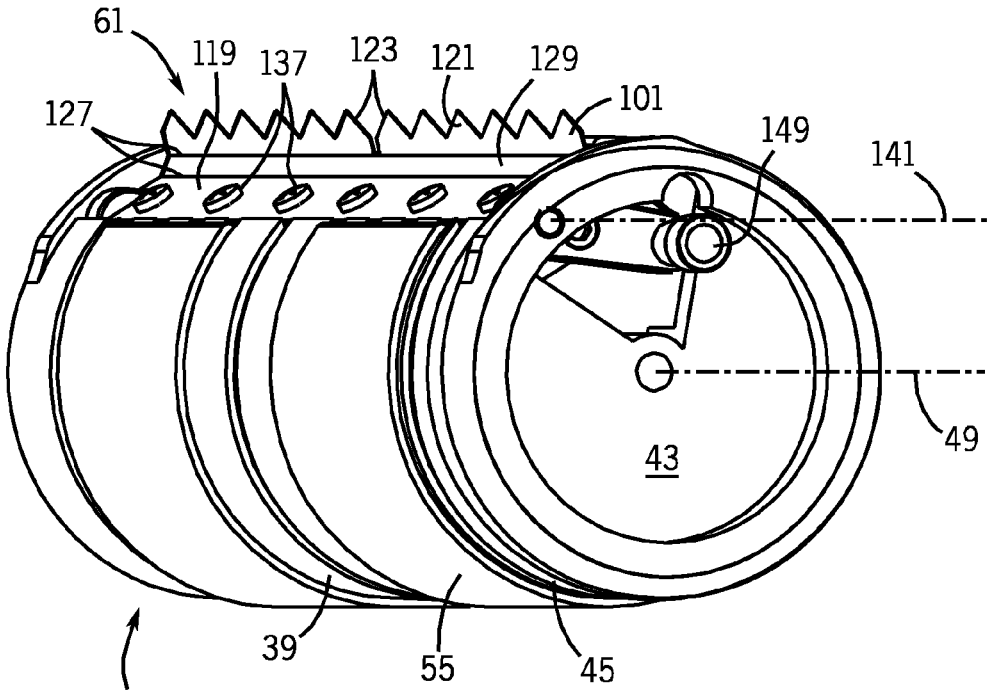
FIG. 10 is a perspective view of an exemplary drive roller suitable for use in the dispenser of FIG. 1.

Blade carrier 103 is pivotably mounted within drive roller 19 along pivot axis 141 which is proximate drive roller 19 circumference 45 and adjacent blade-extending opening 47. As shown in FIG. 10, axis 141 is preferably below circumference 45. Carrier 103 pivots between the non-cutting position shown in FIG. 13 in which knife 121 is inside drive roller 19 or just at circumference 45, through the intermediate cutting position shown in FIG. 14 wherein knife 121 is at about 90° to a tangent of drive roller 19 (i.e., generally perpendicular to web 29) and the full extension position shown in FIG. 15 in which knife 121 is at about 110° to a tangent of drive roller 19. Full web 29 severing occurs between the intermediate and full extension positions (FIGS. 14-15) when the base of serrated edge 123 extends into contact with the web 29 of sheet material and knife 121 is near perpendicular to web 29. (Some web material 29 types may stretch before full severing so the precise point of severing may vary from material to material.) Web severing occurs no later than with the blade 101 in the position shown in FIG. 15. Preferably, web severing occurs between about 70° to about 110° to the tangent of circumference 45 at the point of cutting. Such angle is a highly efficient cutting angle ensuring that energy is efficiently used to sever web 29.

Figure 12:
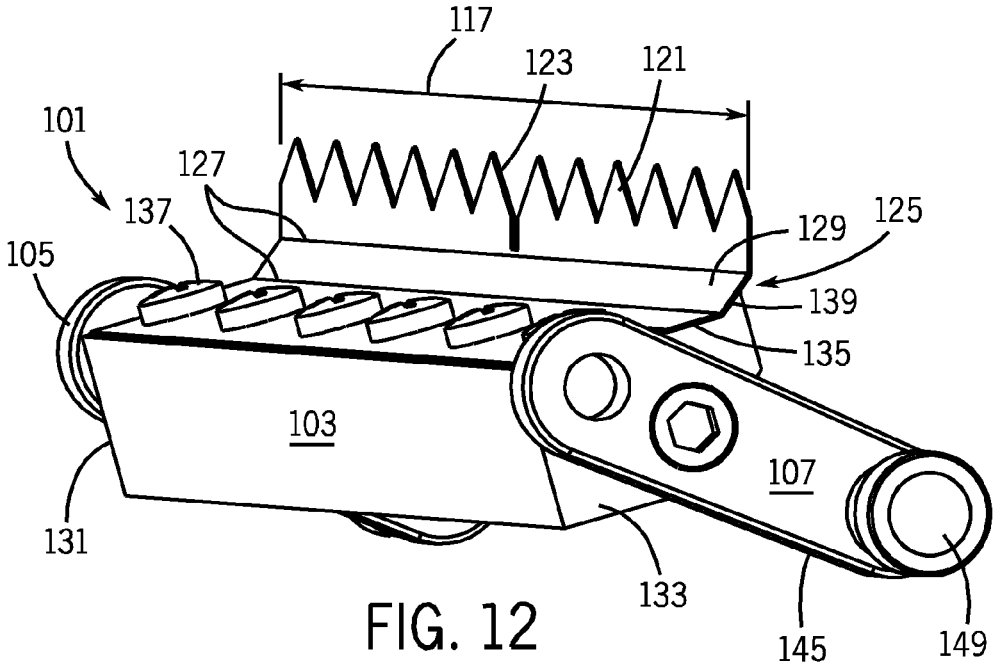
FIG. 12 is a perspective view of a blade and blade carrier suitable for use with the dispenser of FIG. 1 and drive roller of FIGS. 10 and 11.
Figure 11:
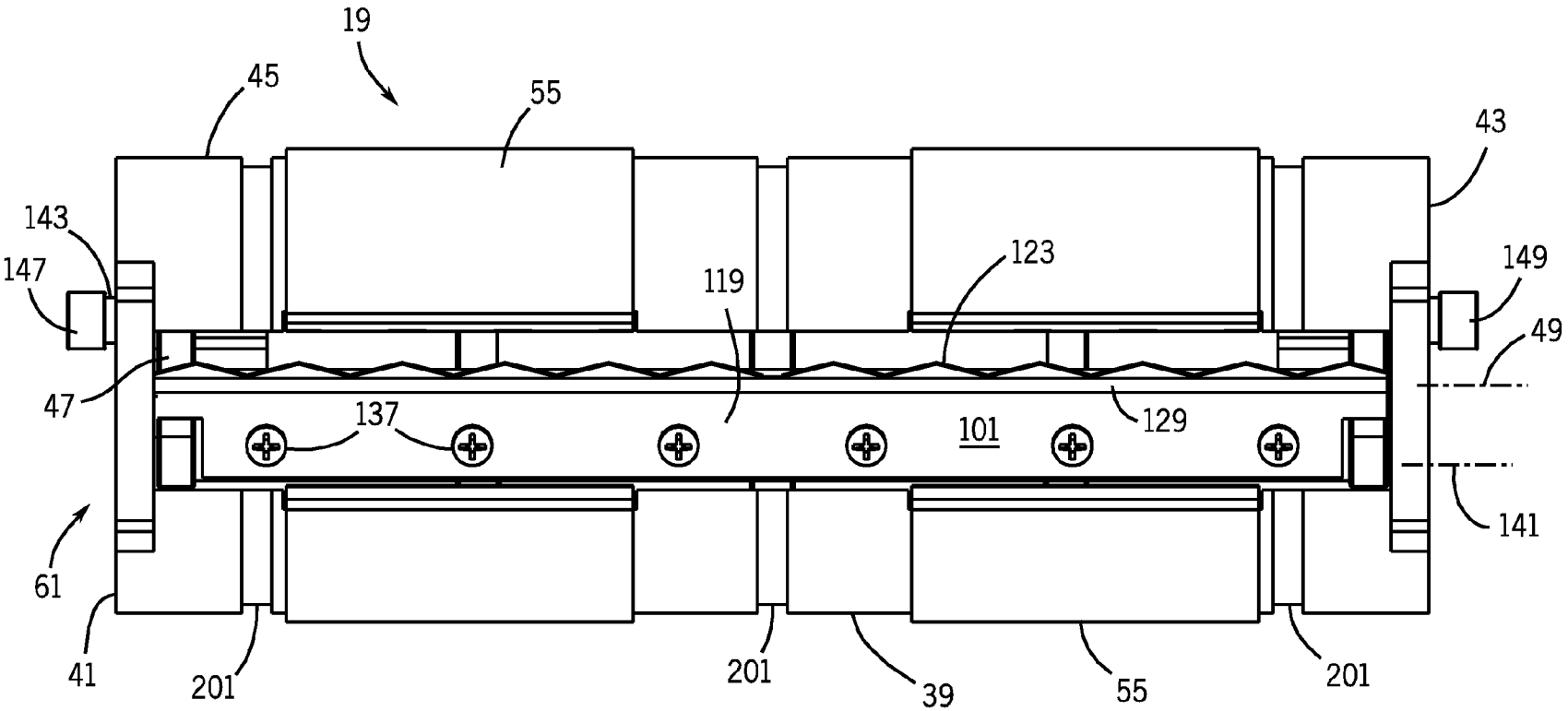
FIG. 11 is a side elevation view of the exemplary drive roller of FIG. 10.

Referring to FIG. 12, a cam follower arm 105, 107 is secured to each end 131, 133 of carrier 103. Direct attachment of arms 105, 107 permits arms 105, 107 to be carried within drive roller 19 as shown in FIGS. 10 and 11. This, in turn, strengthens carrier 103 by avoiding any necessity for separate connecting structure between carrier 103 and arms 105, 107 needed to position arms 105, 107 outside of drive roller as is sometimes done in other dispensers. Such connecting structure may represent a relatively weak structural point which permits unwanted flexing of carrier, thereby reducing cutting force applied to web 29. Preferably, carrier 103 and arms 105, 107 are a single piece plastic part. However, arms 105, 107 may be secured to carrier 103 by fasteners as shown in FIG. 12. Arms 105, 107 extend to a distal end 143, 145 to which a cam follower 147, 149 is rotatably attached.

Figure 13:
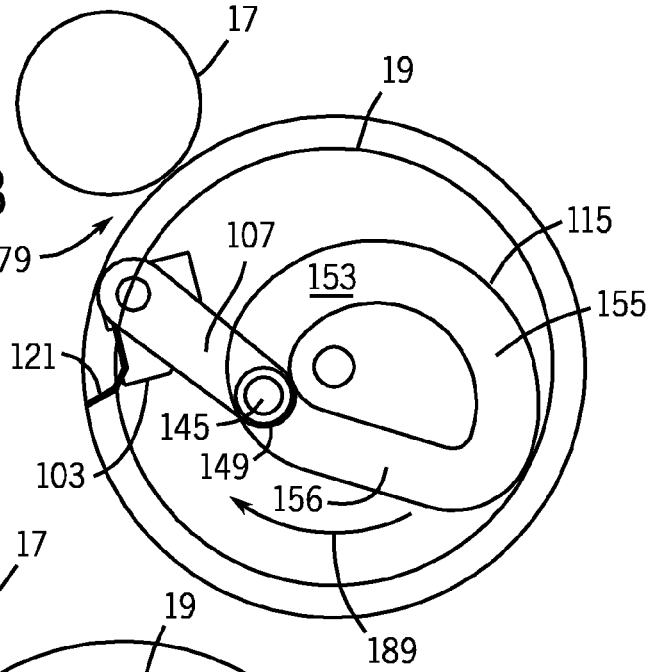
FIGS. 13-15 are schematic side elevation views of the exemplary drive roller and cutting mechanism used in the dispenser of FIG. 1 viewed in the direction of line 13-13 of FIG. 3 showing the position of certain cutting mechanism and other components during different stages of a dispense cycle, certain parts being omitted to facilitate understanding of the apparatus and methods of operation.
Figure 14:
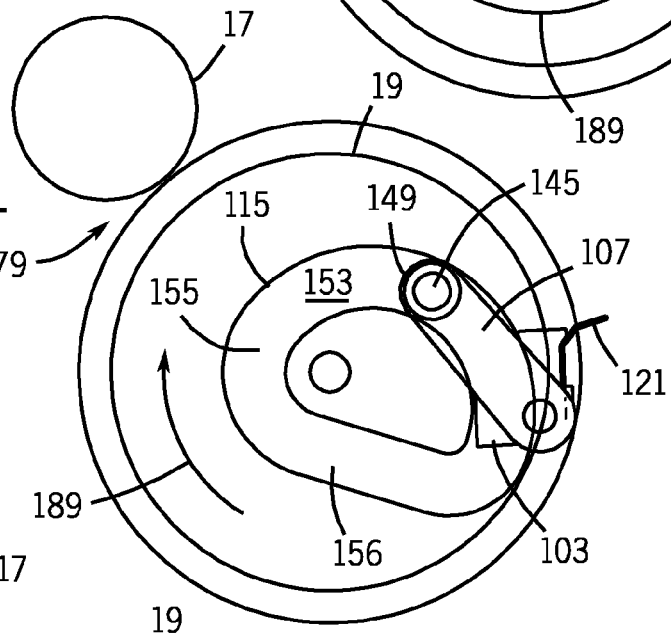
Figure 15:
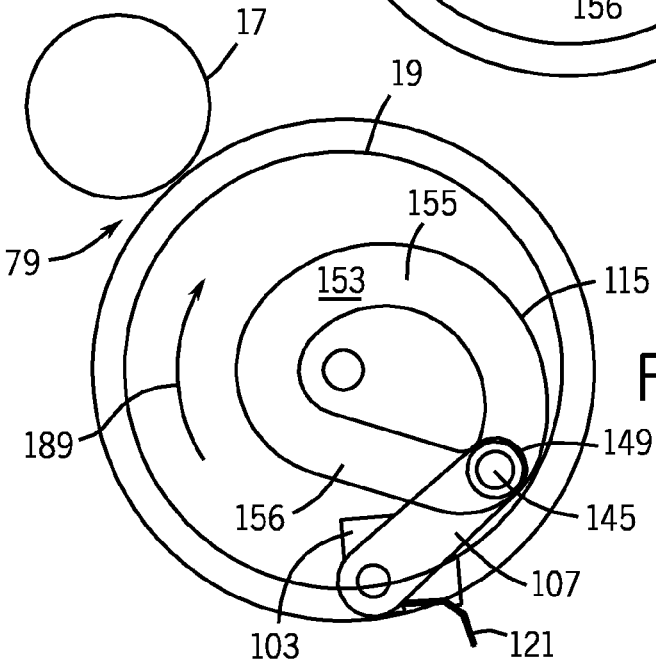

Carrier 103 is pivoted between the positions shown in FIGS. 13-15 by stationary cams 113, 115 acting through followers 147, 149 and arms 105, 107. As shown in FIGS. 7 and 13-15, each cam 113, 115 is mounted to opposed surfaces of walls 51, 53 so that cams 113, 115 face each other. Each cam 113, 115 includes a stationary cam track 151, 153 which receives a respective cam follower 147, 149. Cam tracks 151, 153 are configured so that cam followers 147, 149 move along cam tracks 151, 153 during drive roller 19 rotation and urge carrier 103 and blade 101 to move between the cutting and non-cutting positions during the dispense cycle.

FIGS. 13-15 are taken from the right side of dispenser 10 looking left and show exemplary cam 115. Cam 113 is a mirror image of cam 115 and cams 113, 115 are oriented so that they are in phase with the other. Use of two cams 113, 115 is preferred because such double-ended driving of blade carrier 103 and blade 101 provides more positive and stable operation with lower energy losses. One cam could be used in place of two cams 113, 115. Cams 113, 115 are preferably integral with a respective wall 51, 53 or are secured by fasteners or adhesive to wall 51, 53.

Cam tracks 151, 153 provided in cams 113, 115 include first and second portions 155, 156 with portion 155 being generally curved and portion 156 being generally straight in the example. Cam followers 147, 149 travel around respective cam track 151, 153 one full revolution as drive roller 19 rotates during a dispense cycle. Cutting of the sheet material web 29 benefits from the mechanical advantage inherent in the lever arm configuration of carrier arms 105 and 107 and the action of cams 113 and 115 on cam followers 147 and 149. The mechanical advantage provides a force magnifier averaging about 2 to 1 in the examples. This mechanical advantage may also contribute to the efficiency of cutting mechanisms 61.

Referring again to FIGS. 13-15, those drawings show the positions of followers 147, 149 within cam tracks 151, 153 during a single dispense cycle. As noted above, FIG. 13 shows the drive roller 19 and cam followers 147, 149 in the initial "resting position." Pulling of web 29 causes movement of drive roller 19 in the direction of arrow 189. Movement of drive roller 19 causes movement of cam followers 147, 149 in cam tracks 151, 153. Movement of cam followers 147, 149 along curved portion 155 of cam tracks 151, 153 causes arms 105, 107 to act on blade carrier 103 to pivot blade 101 out of blade-extending opening 47 in drive roller 19. When cam followers 147, 149 are in approximately the middle of curved portion 155 (FIG. 14), knife portion 121 of blade 101 is approximately perpendicular to tangent and is thrust fully or near fully through web 29. When cam followers 147, 149 are in the junction between portions 155, 156 (FIG. 15), knife portion 121 of blade 101 is about 110° to tangent and blade 101 is thrust fully through web 29 severing a sheet of web 29 material 29 from web. Full severing of sheet material web 29 occurs no later than with cam followers 147, 149, carrier 103 and blade 101 in the position as shown in FIG. 15.

Drive roller 19 is in an identical fixed angular position in each dispense cycle when blade 101 is fully extended as in FIG. 15. In the embodiments, this position of drive roller 19 with cams 151, 153 acting on followers 147, 149 to urge blade 101 to the fully extended position corresponds to the "cutting position" of the drive roller 19.

After cutting, drive roller 19 is biased by spring 81 to rotate a rotational distance to a further angular position which corresponds with the "resting position" of FIG. 13. As drive roller 19 rotates between the angular positions corresponding to the cutting and resting positions, a new tail 30 is extended out of dispenser 10.

Use of tail-length adjustment apparatus 23 enables the attendant to increase or decrease the length of tail 30 which extends from dispenser 10 making it easier to use dispenser 10. Change of tail 30 length is accomplished by changing the position of spring 81 with positioner 89 to rotate drive roller 19 to either increase or decrease the rotational distance between the fixed angular position corresponding to the cutting position and the adjustable angular position corresponding to the resting position. This change in rotational distance correspondingly increases or decreases the length of tail 30. In the example of FIGS. 1-8, the position of spring 81 is changed by moving base 91 with set screw 93 to a position along slot 95. In the embodiment of FIG. 19, the position of spring 81 is changed by moving locking knob 97 to a position along slot 99. Spring 81 acts on drive roller 19 through arm 87 to rotate drive roller 19 to the corresponding resting position thereby adjusting tail 30 length. FIG. 19 shows three different positions of knob 97 and drive roller 19 and the corresponding change in tail 30 length.

Referring next to FIGS. 1, 4-6, 16-18 and 20, there is shown an embodiment of a sheet material conservation apparatus 21. Apparatus 21 is useful to encourage a user to consume a single sheet of web material 29 per use. Saving just one sheet of material 29 during each use represents a significant cumulative saving of sheet material over the service life of dispenser 10, thereby reducing the cost of dispenser operation and limiting waste.

In the embodiment, conservation apparatus 21 comprises stop member 157, controlled member 159, and control circuit 161. Stop member 157 is preferably a cam which is mounted on stub shaft (not shown) along drive roller end 43 and which co-rotates with drive roller 19. Stopping of cam rotation pauses rotation of drive roller 19 between dispense cycles to prevent repeated, immediate cycling of dispenser 10 thereby encouraging use of a single sheet of material 29 by the user. Cam-type stop member 157 includes a peripheral surface 163 and a stop surface 165 which, in the example, extends outward from peripheral surface 163. Cam-type stop member 157 further includes a lobe 167 which extends outward from surface 163. Other arrangements are envisioned. For example, stop surface 165 could be a recessed portion of stop member 157 and lobe 167 could be a post or a recessed portion. Use of a cam-type stop member 157 is preferred but other structures could be utilized.

Figure 5:
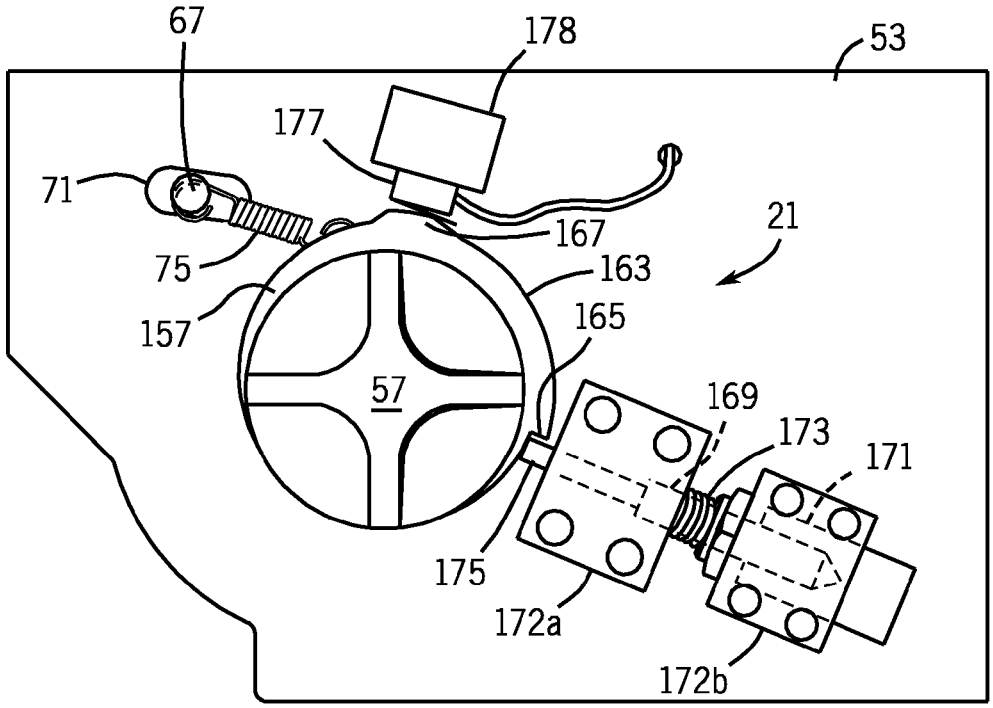
FIGS. 5-6 are side elevation views of portions of the dispenser of FIG. 1 showing certain components of a preferred sheet material conservation apparatus.
Figure 6:
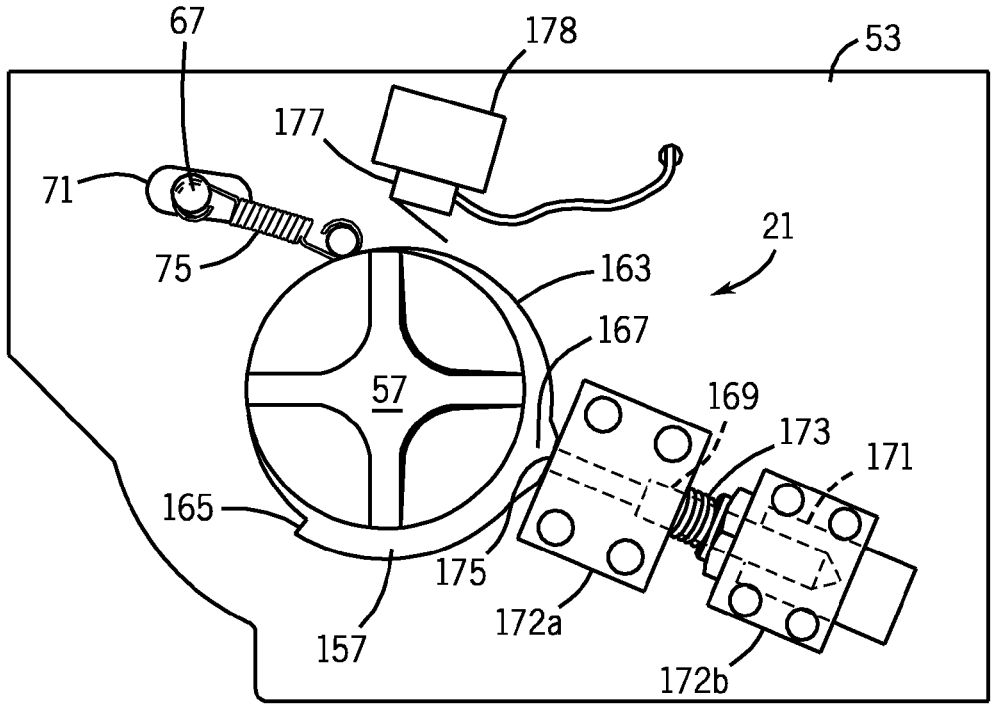
Figure 16:
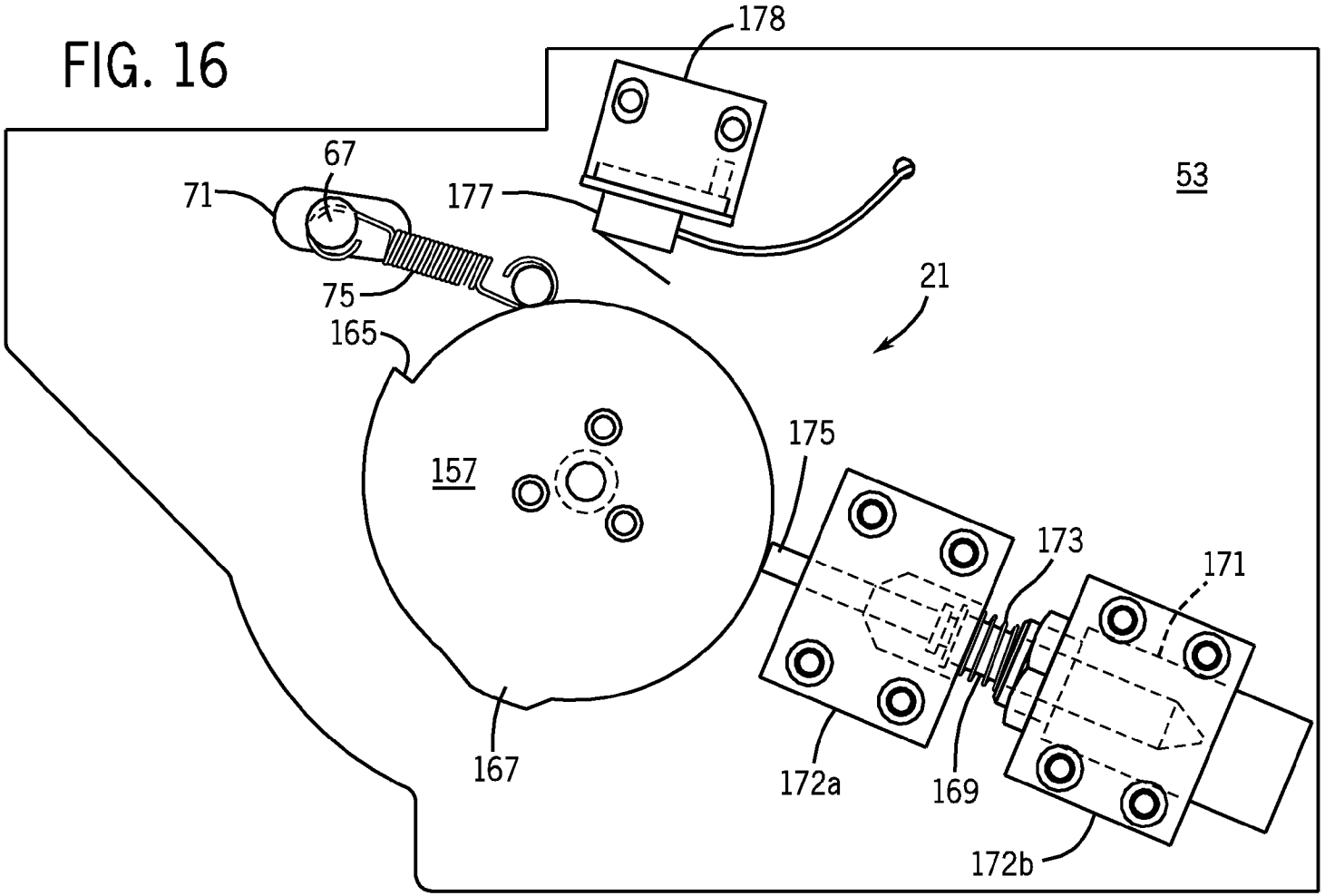
FIGS. 16-18 are schematic side elevation views of the exemplary sheet material conservation apparatus used in the dispenser of FIG. 1 showing the position of preferred components during different stages of a dispense cycle, certain parts being omitted to facilitate understanding of the apparatus and methods of operation.
Figure 17:
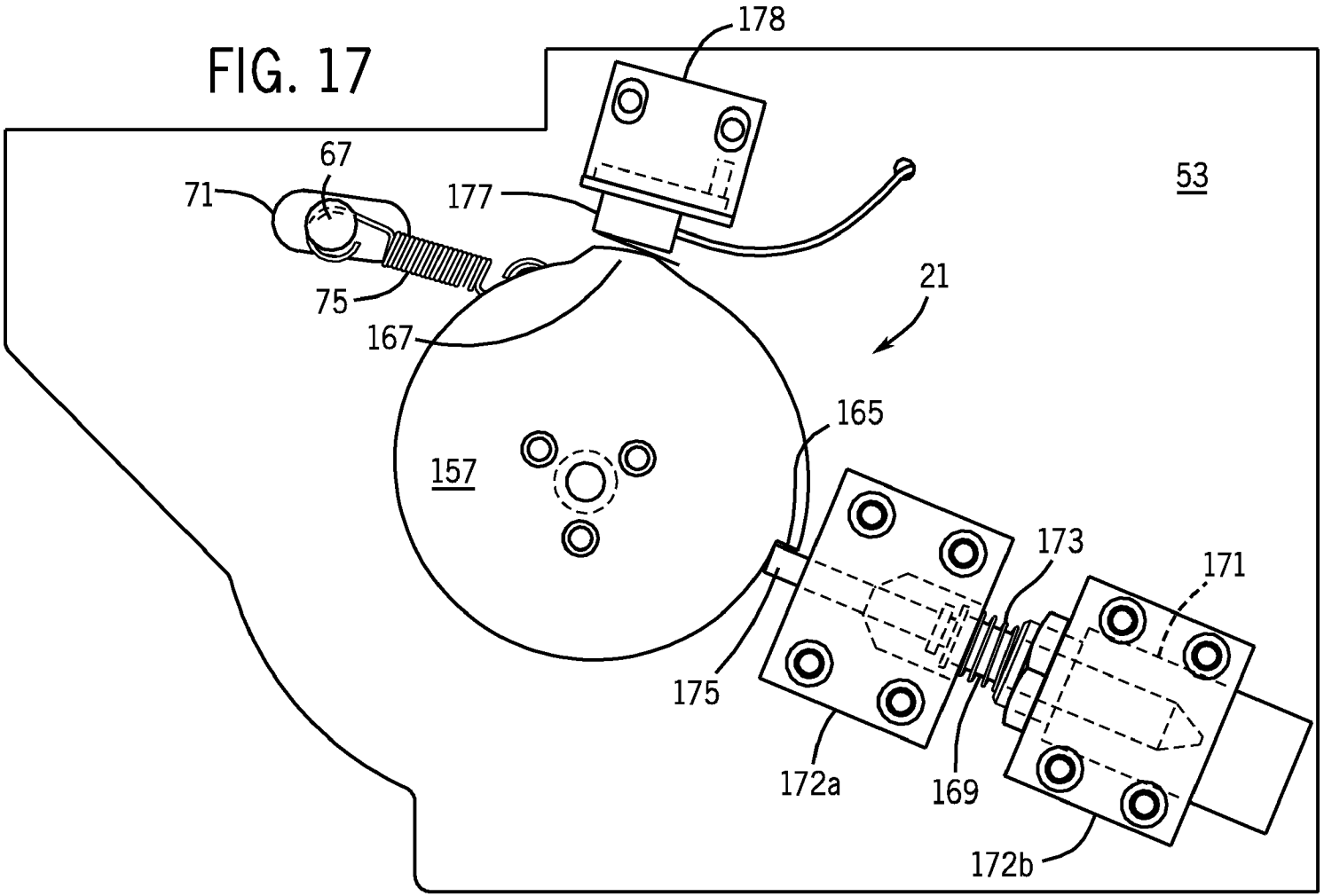

Controlled member 159 is most preferably armature 169 of solenoid 171. Solenoid 171 may be supported along wall 53 by mounts 172*a* and 172*b*. When solenoid 171 is in a de-energized state, armature 169 is in a "first position" in which armature 169 is biased outward of solenoid 171 by spring 173. In the first position, armature end 175 rides on, or is closely proximate to, stop member 157 peripheral surface 163 as shown in FIG. 16. Also in the first position, armature end 175 is contacted by stop surface 165 as cam-type stop member 157 co-rotates with drive roller 19 to pause drive roller rotation as seen in FIGS. 5 and 17. Stop surface 165 and lobe 167 are positioned along peripheral surface 163 so that cam urges lobe 167 into contact with switch 177 of control circuit 161 to close switch 177 before or during contact between stop surface 165 and armature end 175. Switch 177 may be supported along wall 53 by mount 178.

Closing of switch 177 responsive to drive roller 19 rotation of lobe 167 into contact with switch 177 triggers control circuit 161 to initiate a timed delay after which circuit 161 momentarily energizes solenoid 171 to move armature to a "second position" in which the armature 169 releases stop surface 165 to permit further drive roller 19 rotation to the resting position under influence of spring 81.

Figure 18:
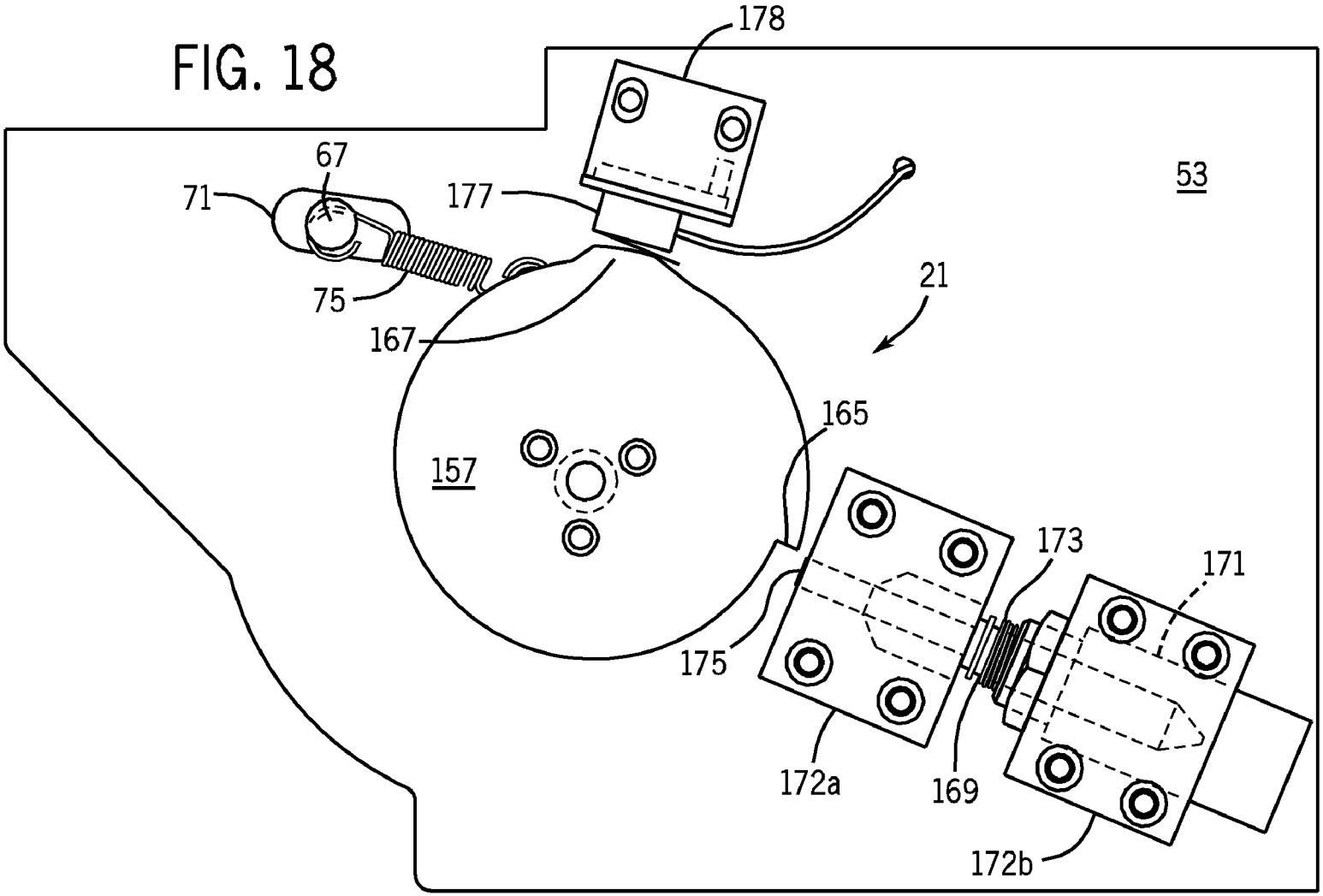

Movement of armature 169 to the second position occurs after a predetermined delay time imposed by control circuit 161. The delay time may be adjustable by the attendant, for example, in delay times of 1 second, 2 seconds or 3 seconds by means of a jumper, rocker switch, or like control. This second position is illustrated in FIG. 18.

Figure 20:
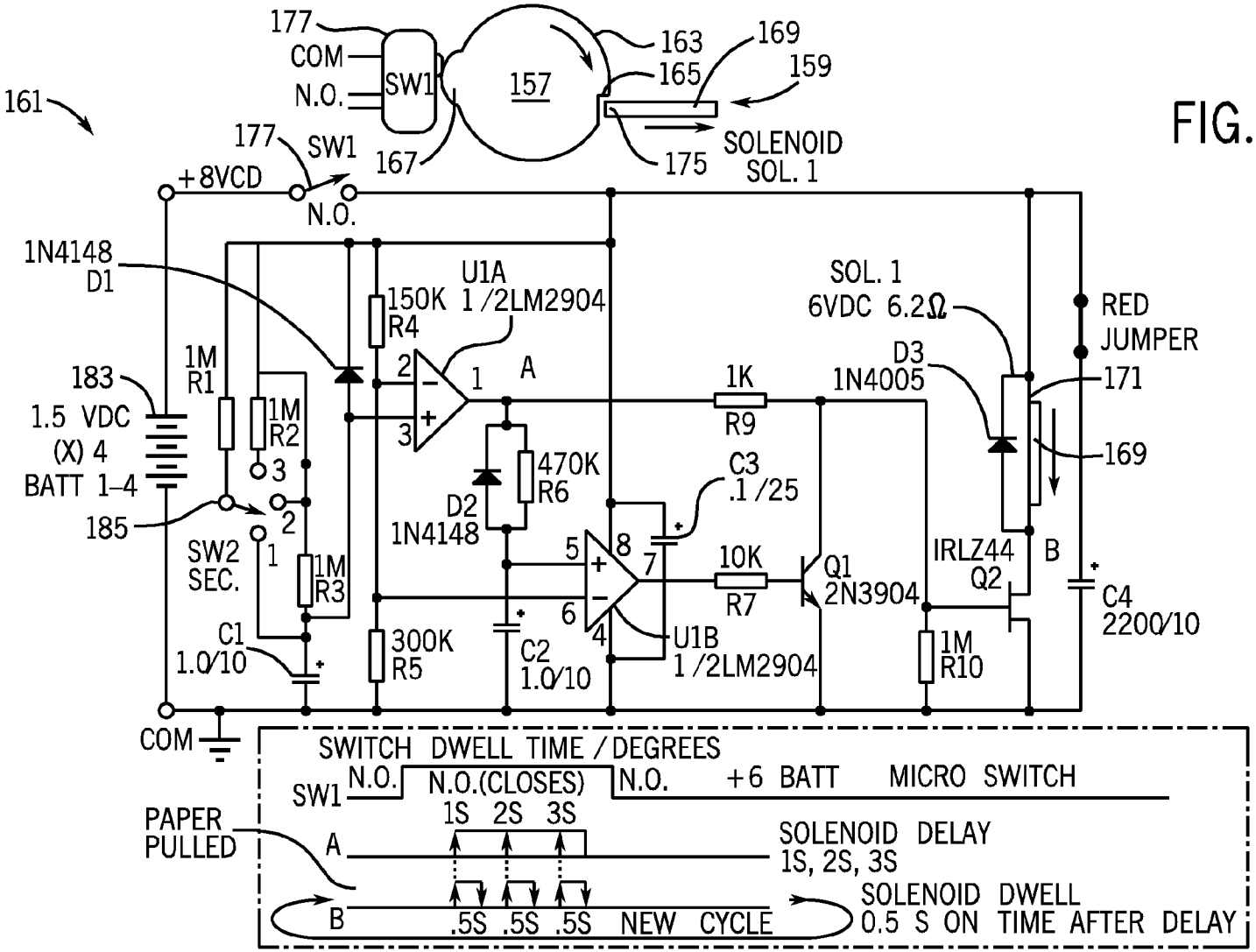
FIG. 20 is a schematic illustration of an exemplary control circuit suitable for use with the exemplary sheet material conservation apparatus of FIG. 1.

FIG. 20 is a schematic diagram showing one embodiment of a control circuit 161 suitable for use in controlling operation of solenoid 171 (SOL1) and armature 169. The electrical components of control circuit 161 may be located on a printed circuit board 179 secured to housing 11 as shown in FIG. 3. A battery box 181 holds four series-connected dry-cell batteries 183 which supply six-volt DC electrical power to control circuit 161 for all circuit functions.

In the embodiment, switch 177 (SW1) of control circuit 161 closes after contact with lobe 167. When switch 177 (SW1) closes, control circuit 161 initiates the delay before energizing solenoid 171. Resistors R4 and R5 are a voltage divider setting a reference voltage on both inverting inputs of amplifiers U1A and U1B. The reference is set by the voltage drop across resistor R5 (Vref). Timing is defined as $T=C\times R\times Ln(V_{batt}-V_{initial})/(V_{batt}-V_{ref})$ or $T=C1\times R1\times Ln((6-0)/(6-4))$, where C is in farads, R is in ohms, T is in seconds and V is in volts. Ln(3) is about equal to 1 or 1 second for R1=1 Mohm; delay=1 second. The cycle time of the solenoid is $Ln(3\times C2\times R6)$ or 0.47 seconds. This time is sufficient to assure that armature 169 is withdrawn to the second position out of contact with stop surface 165 and so that drive roller 19 and associated stop member 157 are free to rotate to the resting position awaiting the next dispense cycle. Energizing of solenoid 171 for just a fraction of a second assures that the power consumed is limited, thereby providing for long battery life.

Referring further to FIG. 20, switch 185 (SW2) is provided to permit the attendant to change the delay time. The longer the delay, the more likely it is that the user will use a single sheet of sheet material from web 29. Switch 185 (SW2) is movable between three positions in the example. In position 1, switch 185 connects to resistor R1 for an approximate 1 second delay as defined above. In switch position 2, the addition of 1 Mohm resistor R3 provides 2 Mohm total resistance for an approximate 2 second delay. In switch position 3, the addition of 1 Mohm resistor R2 provides an approximate 3 second delay. The delay represents the delay time in seconds from when switch 177 (SW1) is closed to when solenoid 171 is energized to move armature 169. The total delay time, can be modified within reasonable limits by the selection of resistor values for any of the design resistors R1 through R3.

After solenoid 171 is energized, solenoid 171 is later de-energized by a predetermined pull-in timer. The timer is defined by amplifier U1B, R5 (Vref), R6, C2 or determined by R6 and C2 as 0.47 seconds.

Initially when switch 177 (SW1) closes, capacitors C1 and C2 are discharged. C1 is charged through the network R1, R2, R3 and SW2 by battery voltage Vbatt. The voltage drop across C1 is initially zero and rises to Vbatt. Because the voltage drop across C1 is lower at the non-inverting input of amplifier U1A as compared to the voltage at the inverting input of U1A, then the output of U1A is a logic low and stays low until the voltage drop across C1 is equal to or greater than the inverting input, at which point the output becomes a logic high. A high output at amplifier U1A through R9 turns on semiconductor power switch Q2.

A high output at U1A through R6 begins charging capacitor C2. Because the voltage drop across C2 is lower at the non-inverting input of amplifier U2A as compared to the voltage at the inverting input, then the output of U2A is a logic low and stays low until the voltage drop across C2 is equal to or greater than the inverting input, at which point the output becomes a logic high. A high output at amplifier U2A through R7 turns on semiconductor switch Q1. When Q1 turns on, the controlling input to semiconductor switch Q2 is pulled logic low and Q2 turns off. When Q2 turns off power to solenoid 171 (SOL1), armature 169 end 175 is biased toward stop member 157 peripheral surface 163 by spring 173.

Diodes D1 and D2 are a discharge path for capacitors C1 and C2 respectively. Quick resetting discharge of capacitors C1 and C2 is necessary for fast cycle-time recovery between dispensing cycles. Capacitors C3 and C4 are for power supply Vbatt noise and power conditioning.

Preferably, cutting of web 29 by cutting mechanism 61 occurs shortly before or during contact between stop surface and armature end 175. If a cutting mechanism 61 is not provided, a stationary cutter bar (not shown) could be provided so that the user could tear off a single sheet of web 29 material during the pause in drive roller 19 rotation.

Operation of exemplary dispenser 10 will now be described particularly with respect to FIGS. 1, 7 and 13-19. It will be understood that FIGS. 13-15 illustrate representative positions of drive roller 19 and other dispenser 10 components during a dispense cycle.

Figure 7:
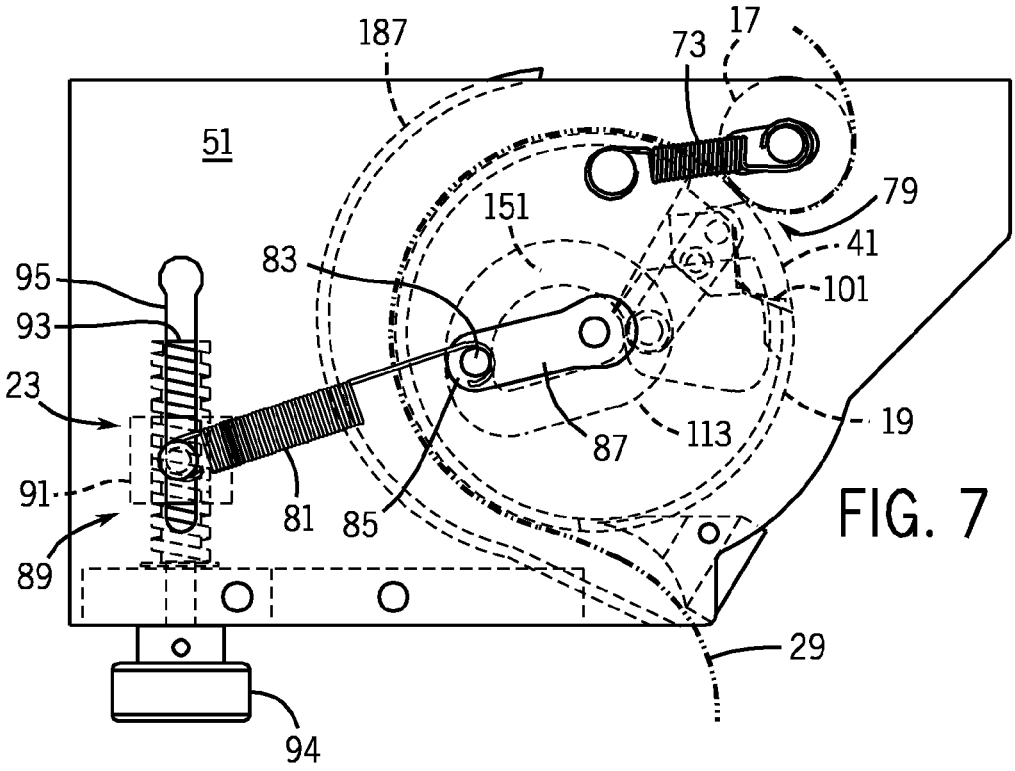
FIG. 7 is a side elevation view of portions of the dispenser of FIG. 1 showing components of one embodiment of a tail length adjustment apparatus.
Figure 8:
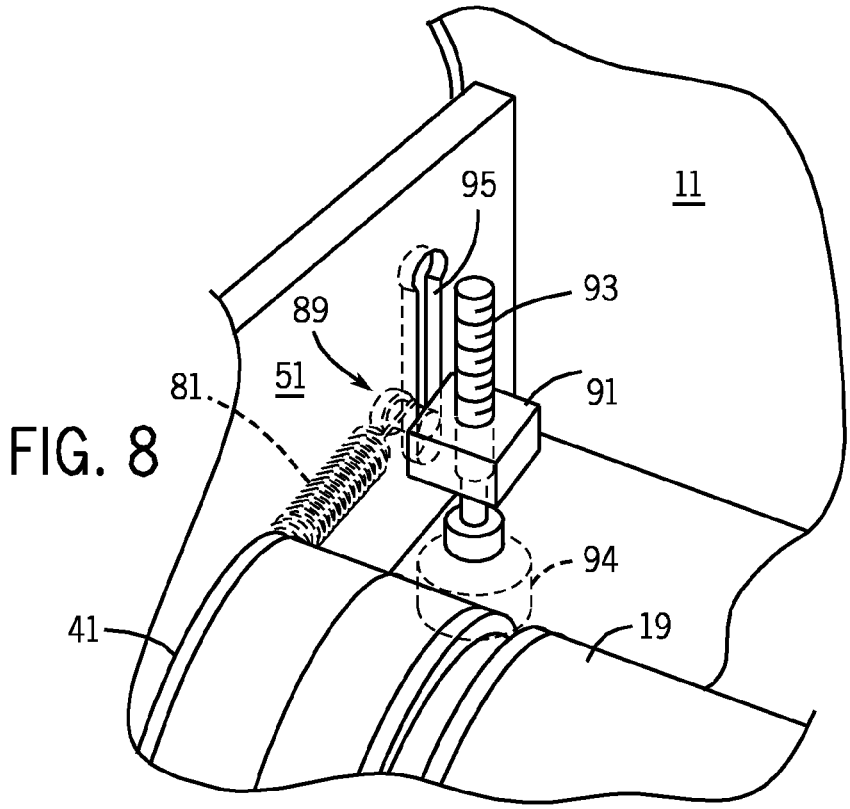
FIG. 8 is an enlarged perspective view of the dispenser of FIG. 1 further showing components of the exemplary tail length adjustment apparatus embodiment of FIG. 7.

FIGS. 1, 7 and 13 represent dispenser 10 in a rest, or ready, position prior to commencement of a dispense cycle. Web 29 is positioned between drive roller 19 and tension roller 17 through nip 79. To facilitate threading of web 29 into nip 79 during loading of web 29, drive roller 19 may be manually rotated by means of hand wheel 57. As drive roller 19 is rotated, friction surfaces 55 engage web 29 which is urged against such friction surfaces 55 by tension roller 17 and, potentially, by the action of user web pulling.

After exiting nip 79, web 29 is guided toward discharge opening 59 by curved guide wall 187 (FIGS. 7 and 19). Web 29 is positioned, or wrapped, over a portion of drive roller 19 outer surface friction surfaces 55. Web tail 30 is then extended from discharge opening 59 by rotation of hand wheel 57 to an appropriate length for gripping by a user. Web 29 is now positioned for dispensing from dispenser 10.

In the rest, or ready, position of FIGS. 7 and 13, spring 81 is de-energized, serving merely as a brake to limit further rotational movement of drive roller 19. At the beginning of a dispense cycle, blade 101 is preferably retracted within drive roller 19 also as shown in FIG. 13.

FIG. 14 represents dispenser 10 shortly after commencement of a dispense cycle. The dispense cycle is initiated by user web pulling of web 29 tail 30. The tension, or pulling, force of web 29 against drive roller 19 outer surface friction surfaces 55 causes drive roller 19 to rotate in the direction of arrow 189. Carrier 103 pivots outwardly moving blade 101 toward web 29 to perforate web 29 as cam tracks 151, 153 of cams 113, 115 urge followers 147, 149 and arms 105, 107 to pivot blade carrier 103. Knife 121 is about perpendicular to web 29 (about 90° to the tangent of the drive roller), a highly-efficient cutting position. At this point in the dispense cycle and as shown in FIG. 16, end 175 of armature 169 is riding on peripheral surface 163 of cam-type stop member 157.

FIG. 15 represents yet a further position of dispenser 10 after commencement of a dispense cycle. Blade 101 moves further toward web 29 to fully sever web 29 as cam tracks 151, 153 of cams 113, 115 continue to urge followers 147, 149 and arms 105, 107 to pivot blade carrier 103. Knife 121 is about 110° to tangent. A single sheet of web 29 sheet material has been separated from web 29 by cutting mechanism 61 and the sheet comes free from web 29 into the user's hand. The efficient cutting mechanism 61 does not require the assistance of separate springs to power rotation of drive roller 19 to cut through the web 29. Virtually all of the energy for web cutting is provided by user web pulling.

Referring to FIG. 17, at this point in the dispense cycle, or shortly thereafter, end 175 of armature 169 is contacted by stop surface 165 to pause rotation of drive roller 19. Referring further to FIG. 17, contact between lobe 167 and switch 177 SW1 causes control circuit 161 to initiate the delay time determination. In the example, the delay of from 1 to 3 seconds encourages use of the single dispensed sheet by the user. Upon completion of the delay time, solenoid 171 is energized for approximately 0.47 seconds to withdraw armature 169 end 175 from contact with stop surface 165. Spring 81 biases rotation of drive roller 19 to the resting position to extend a new tail 30 out of dispenser 10 for the next user to complete the dispense cycle.

The length of tail may be adjusted by operating the tail length adjustment apparatus 23 by repositioning base 91 with set screw 93 along slot 95 or by moving locking knob 97 to a new position along slot 99. As previously described, the action of spring 81 and arm 87 causes drive roller 19 to rotate to one of plural angular positions and this change in distance between the first and second angular positions correspondingly changes the length of tail 30 extending from dispenser 10.

Dispenser 10 and its component parts may be made of any suitable material or combination of materials as stated above. Selection of the materials will be made based on many factors including, for example, specific purchaser requirements, price, aesthetics, the intended use of the dispenser and the environment in which the dispenser will be used.

While the principles of this invention have been described in connection with specific embodiments, it should be understood clearly that these descriptions are made only by way of example and are not intended to limit the scope of the invention.

What is claimed is:

1. A sheet material dispenser comprising:

a housing;

a sheet material roll holder within the housing;

drive and tension rollers supported within the housing and forming a nip therebetween, the drive roller having a circumference, a rotational axis, ends, and a generally cylindrical body having a blade-extending opening between the ends, the body being positioned such that sheet material passes through the nip and wraps partially around the body during sheet material pulling and movement of the sheet material rotates the drive roller;

a blade having a length, a base, a knife with a serrated edge, and a transition between the base and knife along the length, the transition including a stiffening compound bend comprising, at least two bends and at least one planar section between the bends;

a blade carrier having ends, a first surface abutting and supporting the base and a second surface abutting and supporting at least a portion of the at least one planar section, the blade carrier being pivotably mounted within the drive roller along a pivot axis proximate the drive roller circumference and adjacent the blade-extending opening for pivoting movement between a cutting position in which the knife serrated edge is extended through the opening to sever the sheet material and a non-cutting position;

a pair of cam follower arms, each arm being secured to one carrier end and having a cam follower spaced from the carrier; and a pair of stationary cam tracks, each cam track being associated with an opposed housing wall and receiving one of the cam followers, said cam tracks being configured such that the cam followers move along a respective cam track during drive roller rotation and urge the carrier and blade to move between the cutting and non-cutting positions during a dispense cycle.

2. The dispenser of claim 1 wherein the knife has a thickness of about 0.0105 inches.

3. The dispenser of claim 2 wherein the knife is made of 300 series half-hard stainless steel.

4. The dispenser of claim 3 wherein the blade base is secured to the carrier along the entire blade length.

5. The dispenser of claim 4 wherein the blade carrier and carrier arms are a one-piece part.

6. The dispenser of claim 5 wherein the blade carrier is pivotably mounted such that the knife is oriented between about 70 and about 110 degrees to a tangent of the drive roller circumference during severing.

7. The dispenser of claim 6 wherein the blade carrier is pivotably mounted such that the knife is oriented substantially perpendicular to a tangent of the drive roller circumference at a sheet material severing point.

8. A blade assembly for a sheet material dispenser comprising:

a blade having a length, a base, a knife with a cutting edge, and a transition between the base and knife along the length, the transition including a stiffening compound bend comprising at least two bends and at least one planar section between the bends;

a blade carrier having ends, a first surface abutting and supporting the base and a second surface abutting, and supporting at least a portion of the at least one planar section, the blade carrier being capable of pivotable mounting within a dispenser drive roller along a blade carrier pivot axis; and at least one cam follower arm secured to a carrier end and having a cam follower spaced from the carrier adapted to be received in a sheet material dispenser cam track.

9. A sheet material dispenser comprising:

a housing;

a sheet material roll holder within the housing;

drive and tension rollers supported within the housing and forming a nip therebetween, the drive roller having a circumference, a rotational axis, ends, and a generally cylindrical body having a blade-extending opening between the ends, the body being positioned such that sheet material passes through the nip and wraps partially around the body during sheet material pulling and movement of the sheet material rotates the drive roller;

a blade having a length, a base, a knife with a serrated edge, and a transition between the base and knife along the length, the transition including a stiffening compound bend comprising at least two bends and at least one planar section between the bends;

a blade carrier having ends, a first surface abutting and supporting the base and a second surface abutting and supporting at least a portion of the at least one planar section, the blade carrier being pivotably mounted within the drive roller along a pivot axis proximate the drive roller circumference and adjacent the blade-extending opening for pivoting movement between a cutting position in which the knife serrated edge is extended through the opening to cut the sheet material and a non-cutting position; and a cam which urges the carrier to move the blade supported thereon between the cutting and non-cutting positions during a dispense cycle.

10. The dispenser of claim 9 further comprising:

an arm secured to the carrier and having, a cam follower spaced from the carrier; and a cam track associated with the cam configured such that the cam follower moves along the cam track during drive roller rotation to urge the carrier to move the blade supported thereon between the cutting and non-cutting positions during the dispense cycle.

11. The dispenser of claim 10 wherein the blade carrier and arm are a one-piece part.

12. The dispenser of claim 9 wherein the knife has a thickness of about 0.0105 inches.

13. The dispenser of claim 9 wherein the knife is made of 300 series half-hard stainless steel.

14. The dispenser of claim 9 wherein the blade base is secured to the carrier along the entire blade length.

15. The dispenser of claim 9 wherein the blade carrier is pivotably mounted such that the knife is oriented between about 70 and about 110 degrees to a tangent of the drive roller circumference during cutting.

16. The dispenser of claim 9 wherein the blade carrier is pivotably mounted such that the knife is oriented substantially perpendicular to a tangent of the drive roller circumference at a sheet material cutting position.

* * * * *